US009484637B2

(12) United States Patent
Jardin et al.

(10) Patent No.: US 9,484,637 B2
(45) Date of Patent: Nov. 1, 2016

(54) HORN ANTENNA WITH CORRUGATED GRATING

(71) Applicant: THALES, Neuilly-sur-Seine (FR)

(72) Inventors: Michael Jardin, Toulouse (FR); Claude Labourdette, Toulouse (FR); Thierry Judasz, Ramonville (FR); Bruno Benoist, Seysses (FR); Olivier Martin, Pins Justaret (FR)

(73) Assignee: Thales, Courbevoie (FR)

( * ) Notice: Subject to any disclaimer, the term of this patent is extended or adjusted under 35 U.S.C. 154(b) by 613 days.

(21) Appl. No.: 13/871,195

(22) Filed: Apr. 26, 2013

(65) Prior Publication Data

US 2014/0009351 A1 Jan. 9, 2014

(30) Foreign Application Priority Data

Apr. 27, 2012 (FR) ..... 12 01240

(51) Int. Cl.
*H01Q 15/24* (2006.01)
*H01Q 13/02* (2006.01)
*H01Q 19/02* (2006.01)

(52) U.S. Cl.
CPC ..... *H01Q 15/242* (2013.01); *H01Q 13/02* (2013.01); *H01Q 15/24* (2013.01); *H01Q 19/028* (2013.01)

(58) Field of Classification Search
CPC ..... H01Q 13/02; H01Q 13/0208; H01Q 13/0216; H01Q 13/0225; H01Q 13/0275; H01Q 13/0291; H01Q 15/24
USPC ..... 343/756
See application file for complete search history.

(56) References Cited

U.S. PATENT DOCUMENTS

| | | | | |
|---|---|---|---|---|
| 2,298,272 A | | 10/1942 | Barrow | |
| 2,820,965 A | * | 1/1958 | Sichak | H01Q 25/001 343/756 |
| 3,031,664 A | | 4/1962 | Wielobob | |
| 3,938,159 A | | 2/1976 | Ajioka et al. | |
| 4,119,932 A | * | 10/1978 | Bockrath | H01Q 15/24 333/21 A |
| 5,731,777 A | | 3/1998 | Reynolds | |
| 6,208,309 B1 | * | 3/2001 | Chandler | H01Q 13/0216 343/772 |
| 2011/0205136 A1 | * | 8/2011 | Runyon | H01Q 13/0216 343/786 |

FOREIGN PATENT DOCUMENTS

JP 58-121410 U 8/1983

* cited by examiner

*Primary Examiner* — Sue A Purvis
*Assistant Examiner* — Daniel J Munoz
(74) *Attorney, Agent, or Firm* — Baker & Hostetler LLP

(57) ABSTRACT

A horn that radiates a radioelectric wave coming from an input waveguide, comprises a grating placed over the aperture of the horn. The waveguide comprises a horn-shaped segment, an entrance, an aperture, and a grating placed next to the aperture. It makes it possible for at least one linearly polarised electromagnetic wave to propagate between the entrance and the aperture along a first axis. The grating comprises a frame and a set of plates extending longitudinally and continuously from a first short side of the frame to a second short side of the frame, so as to form a linear polarising filter for any electromagnetic wave the electric field of which is not polarised along a second axis orthogonal to the first axis. The grating of the waveguide comprises corrugations to reinforce the filtering of the electromagnetic wave the electric field of which is not polarised along the second axis.

24 Claims, 6 Drawing Sheets

HORN ANTENNA WITH CORRUGATED GRATING

CROSS-REFERENCE TO RELATED APPLICATIONS

This application claims priority to foreign French patent application No. FR 1201240, filed on Apr. 27, 2012.

FIELD OF THE INVENTION

The invention relates to a horn that radiates a radioelectric wave coming from an input waveguide, comprising a grating placed over the aperture of the horn. It is notably applicable to the field of reflector antennas. The invention also relates to a satellite antenna equipped with this horn.

BACKGROUND OF THE INVENTION

Conventionally, an antenna for emitting and receiving an electromagnetic wave may be produced by associating a waveguide with a radiating element that may, for example, take the form of a horn. A horn-shaped waveguide, more simply called a horn, has a rectangular transverse (i.e. perpendicular to the propagation direction of the wave) cross section that gradually increases towards the aperture. Such a waveguide makes it possible to promote propagation, along its longitudinal axis, of an electromagnetic wave polarised along an axis orthogonal to the longitudinal axis of the horn. The electric field of the electromagnetic wave may be decomposed into a component parallel to the shortest sides of the aperture, and into a component parallel to the longest sides of the aperture. The first component is called the principal or co-polarisation component. The other component is called the cross-polarisation component. In the context of certain applications, it is desirable to reduce as much as possible the amplitude of the cross-polarisation component. One solution consists in placing a grating over the aperture of the horn. A grating is generally made of a metal, for example aluminium. It is formed from a set of plates placed parallel to the longest sides of the aperture of the waveguide. The grating allows the co-polarisation component to pass through and filters the cross-polarisation component of an electromagnetic wave. For a relatively directional horn, for example with a gain higher than 25 dBi, equipped with a grating, it is possible to obtain a cross-polarisation component the amplitude of which is about 40 to 45 dB smaller than the amplitude of the co-polarisation component. However, the effectiveness of the filtering very clearly or even completely decreases when the horn is less directional. This is notably the case for the test horns used in microwave anechoic chambers. Also, the filtering is effective only over a narrow frequency band. With the increasing demand for better antenna performance, it is becoming useful to develop horns providing an attenuation of the cross-polarisation component of at least 40 dB relative to the co-polarisation component, and this over widened frequency bands, for example by about 40% to 50%.

SUMMARY OF THE INVENTION

One aim of the invention is notably to provide a horn having improved properties with respect to the filtering of the cross-polarisation component of the electric field of an electromagnetic wave, both in terms of amplitude of the cross-polarisation component and in terms of bandwidth. For this purpose, one subject of the invention is a waveguide comprising a horn-shaped segment, an entrance, an aperture, and a grating placed next to the aperture, at least one linearly polarised electromagnetic wave being able to propagate between the entrance and the aperture along a first axis, the grating comprising a frame encircling a set of plates extending longitudinally and continuously from a first short side of the frame to a second short side of the frame, so as to form a linear polarising filter attenuating the cross-polarisation component of the electric field of the electromagnetic wave, said cross-polarisation component being orthogonal to a second axis orthogonal to the first axis. The plates comprise corrugations dimensioned and positioned so as to reinforce the attenuation of said cross-polarisation component.

Notably one advantage of the invention is that it can be tailored to any type of horn, notably pyramidal or trifurcated horns. These horns are relatively light, and relatively simple to design and manufacture. Relative to a corrugated horn, a pyramidal or trifurcated horn weighs about half as much. Also, the invention has the advantage of improving the standing wave ratio and the gain of the horn.

The invention may be used in the test equipment of radiofrequency anechoic chambers so as thus to allow more precise and more reliable measurement results to be obtained on the levels of cross-polarisation and of the orientation of the principal polarisation of the devices tested. With better cross-polarisation levels, and by virtue of its simplicity of manufacture and its favourable weight, it will also be possible to use the invention for satellite antenna applications.

The corrugations for example consist in rectangular slits cut in the side opposite the entrance of the waveguide.

Advantageously, the corrugations have dimensions that vary depending on their position in the direction in which the plates extend longitudinally between the first and second short sides of the frame, as a function of the frequency of the electric field of the electromagnetic wave having locally the largest amplitude at the respective corrugations. The filtering may thus be optimised over a wide frequency band.

The depth of the slits is, for example, substantially equal to a quarter of the wavelength corresponding to the frequency of the electric field having locally the largest amplitude at the respective slits, and being essentially oriented along the second axis. The depth of the slits is, in another example, substantially equal to a quarter of the wavelength corresponding to a frequency of an operating frequency band of the waveguide, the electromagnetic wave emitted in said operating frequency band having an electric field essentially oriented along the second axis. Moreover, the higher the frequency, the smaller the width of the slits. Again with the aim of optimising filtering over a wide frequency band, the interval between two adjacent corrugations in the direction in which the plates extend longitudinally is substantially equal to a quarter of the wavelength corresponding to the frequency of the electric field of the electromagnetic wave having locally the largest amplitude at the respective slits. The interval between two adjacent corrugations in the direction in which the plates extend longitudinally is, as a variant, substantially equal to a quarter of the wavelength corresponding to a frequency of an operating frequency band of the waveguide, the electromagnetic wave emitted in said operating frequency band having an electric field essentially oriented along the second axis.

Advantageously, with the aim of optimising the attenuation, the frame comprises corrugations. Advantageously, with the aim of optimising the attenuation, the frame comprises corrugations extending right through the thickness of at least one side of the frame in a direction perpendicular to the first axis.

Advantageously, the frame comprises corrugations extending right through the thickness of at least one side of the frame along the second axis and/or corrugations extending right through the thickness of at least one side of the frame along a third axis orthogonal to the first axis and to the second axis.

According to one particular embodiment, the corrugations are aligned in sets along the second axis, the corrugations of a given set having identical dimensions.

Again according to one particular embodiment, the grating is placed at a non-zero distance away from the aperture of the waveguide along the first axis.

In order to enhance the filtering of the cross-polarisation component, the waveguide may comprise at least one additional grating, the gratings being spaced apart pairwise along the first axis by a distance ranging from the wavelength corresponding substantially to a central frequency of an operating frequency band of the waveguide, to one eighth of this wavelength. One or more of the additional gratings may be placed parallel to the grating placed next to the aperture. Moreover, one or more of the additional gratings may each comprise corrugations. Each additional grating may be substantially identical to the grating placed next to the aperture.

According to one particular embodiment, the grating comprises a frame that substantially follows the perimeter of the waveguide aperture, the frame comprising protruding parts extending in a plane orthogonal to the first axis. The protruding parts for example form a sawtooth profile. The protruding parts may extend towards the interior and/or towards the exterior of the frame.

Advantageously, the plates extend longitudinally in a direction substantially parallel to a third axis orthogonal to the second axis and orthogonal to the first axis.

Advantageously, so as to obtain a better attenuation, the plates extend longitudinally in a direction making, with a third axis orthogonal to the second axis and orthogonal to the first axis, an angle between 0.05° and 5° about the first axis.

Advantageously, the waveguide is designed to operate in an operating frequency band, the plates having a height along the z-axis substantially equal to half a wavelength corresponding to a frequency in the operating frequency band of the waveguide.

Another subject of the invention is a satellite antenna comprising a waveguide such as described above.

The last subject of the invention is a method for testing a radio-frequency device in which a waveguide such as described above is used.

BRIEF DESCRIPTION OF THE DRAWINGS

The invention will be better understood and other advantages will become apparent on reading the following description, given with regard to the appended drawings in which.

DETAILED DESCRIPTION OF THE INVENTION

In the rest of the description, the central frequency of the operating frequency band of an antenna will be denoted $f_0$, the speed of light in the propagation medium considered will be denoted $C_0$, and the wavelength corresponding to the frequency $f_0$ will be denoted $\lambda_0$ (where $\lambda_0=C_0/f_0$). $f_0$ is the central frequency of the electric fields of the electromagnetic waves emitted in the operating band of the antenna. These electric fields are, even before they arrive at the grating, essentially oriented along the y-axis.

Figure 1:
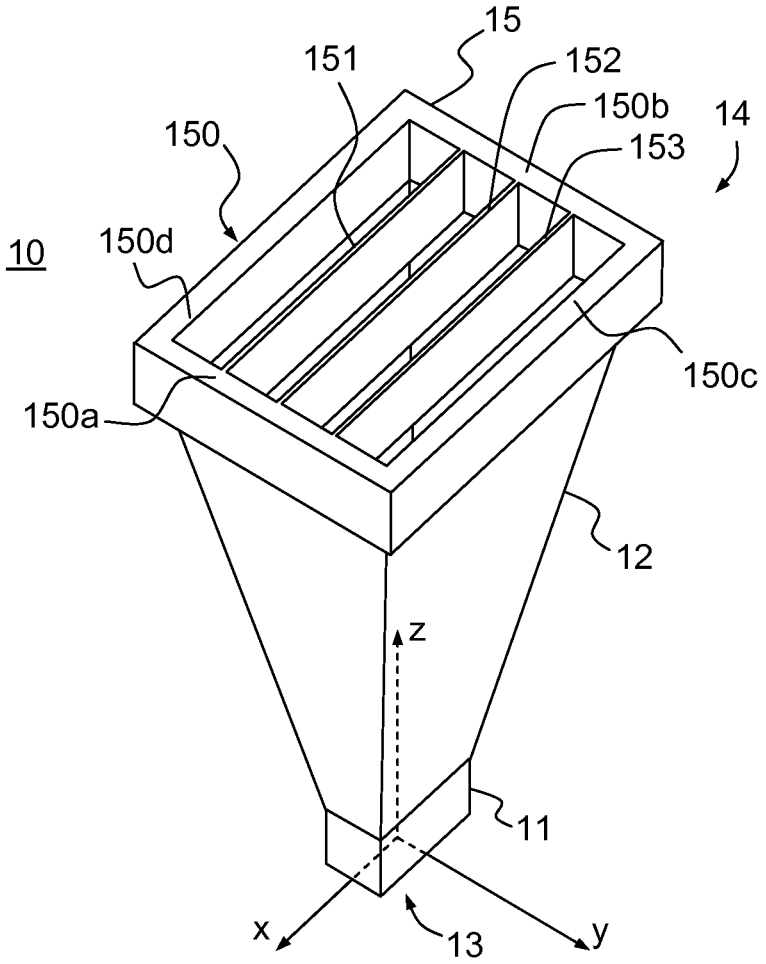
FIG. 1 shows a perspective view of an example of a waveguide having a horn-shaped ending and comprising a simple grating near the aperture.

FIG. 1 shows a perspective view of an example of a horn-shaped waveguide for a reflector antenna. The waveguide is often called a horn with reference to its shape. The horn 10 comprises a first segment 11 having a constant rectangular cross section (in the x-y plane), and a second segment 12 having a rectangular cross section that increases uniformly between the entrance 13 and the aperture 14, i.e. along its longitudinal z-axis. For a given cross section, the largest dimension of this section is oriented along the x-axis, whereas the smallest dimension is oriented along the y-axis. The entrance 13 is generally connected to a rectangular waveguide (not shown) having the same cross section as that of the segment 11. The horn 10 comprises a grating 15 placed next to the aperture 14. The expression "next to" is understood to mean a distance between the wavelength $\lambda_0$ and zero, the grating 15 then being fixed to the perimeter of the aperture 14. The grating 15 comprises a frame 150 that substantially follows the perimeter of the aperture 14, and a set of plates 151, 152 and 153. The frame supports the plates. The plates 151-153 extend longitudinally and continuously along the x-axis from a first short side of the frame 150 to a second short side of the frame. This feature is essential if the cross-component of the electric field of any wave emitted into the waveguide is to be attenuated whatever its position on the grating.

In the embodiment of FIG. 1, non-limitingly, the first short side 150*a* and the second short side 150*b* extend longitudinally parallel to the y-axis. The frame also comprises a first long side 150*c* and a second long side 150*d*, which sides are orthogonal to the sides 150*a*, 150*b*. The frame is rectangular.

The expression "two short sides of the frame" is understood to mean the two shortest sides of the frame and the expression "two long sites of the frame" is understood to mean the two longest sides of the frame.

The plates 151-153 are placed parallel to the x-z plane in the embodiments of the figures. They are placed so as to allow an electromagnetic wave the electric field of which is polarised along the y-axis to pass and to filter any other electromagnetic wave the electric field of which is not polarised along the y-axis. The grating 15 thus forms a linear y-axis polarising filter. The term "filtering" is understood to mean the attenuation of the amplitude of the electric field. The grating 15 notably attenuates what is called the cross-polarisation component of the electric field of an electromagnetic wave, i.e. the component oriented along the x-axis. The grating in particular attenuates the cross-polarisation components of the electric fields of the electromagnetic waves the respective frequencies of which are contained in the operating frequency band of the waveguide. The geometric properties of the grating 15 are essentially defined depending on the operating frequency band of the antenna. The geometric properties having the most significant impact on the electromagnetic properties of the grating are the height of the grating 15 and the interval between adjacent plates, and likewise between the external plates 151 and 153 and the internal edge of the frame 150. Advantageously, the height of the grating 15 along the z-axis is substantially equal to half the wavelength $\lambda_0$ ($\lambda_0/2$). The interval between two adjacent plates, and between the external plates 151 and 153 and the internal edge of the frame 150 is advantageously substantially equal to a quarter of the wavelength $\lambda_0$ ($\lambda_0/4$). Other geometric properties have a secondary influence on the electromagnetic properties of the horn 10. This may notably be the position of the grating 15 relative to the aperture 14. Advantageously, the grating 15 is placed a substantially zero distance away from the x-y plane of the aperture 14. The thickness of the frame 150 along the x- and y-axes and that of the plates 151-153 along the y-axis have little influence on the performance of the grating 15. The thickness of the plates 151-153 depends directly on the size of the aperture 14 of the horn along the y-axis, on the number of plates, and on the interval between the plates. From an electromagnetic point of view, the thickness of the plates 151-153 may be very small. However, the plates 151-153 must be sufficiently thick to be manufacturable and strong. By way of example, the plates may be substantially equal to 1 mm in thickness. The thickness of the frame 150 is essentially chosen in order to allow it to withstand the mechanical stresses undergone by the horn 10. In particular, since the plates 151-153 are relatively thin, the frame 150 must be sufficiently thick to prevent the plates 151-153 from twisting. For a horn intended to be used in an antenna operating in the Ku frequency band, i.e. the frequency band between 10.00 GHz and 15.00 GHz, the frame 150 is for example between 2 and 10 mm in thickness.

Figure 2:
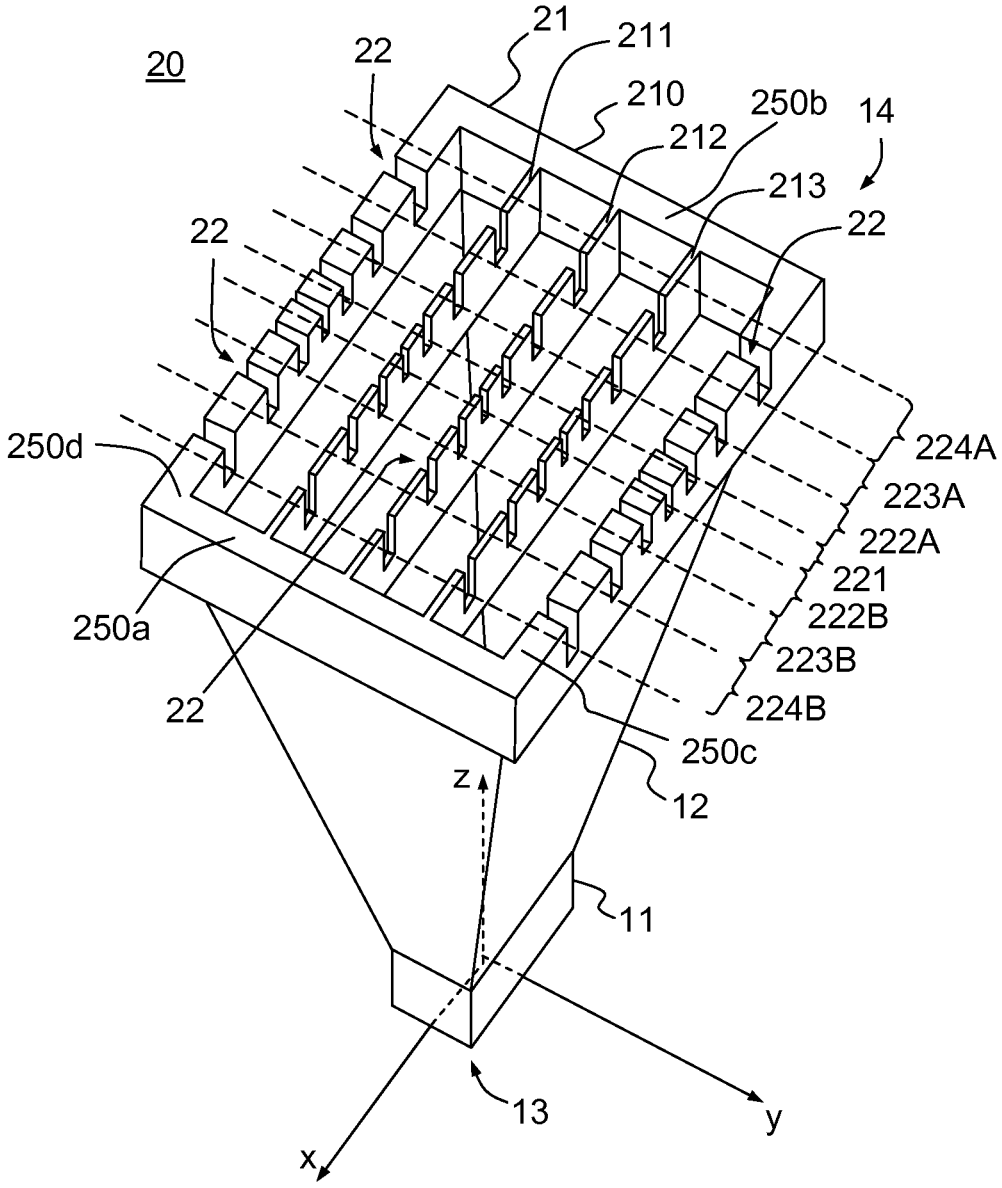
FIG. 2 shows a perspective view of an embodiment of a waveguide having a horn-shaped ending and comprising a grating according to the invention near the aperture.

FIG. 2 shows a perspective view of an example of an embodiment of a horn according to the invention. The horn 20 differs from the horn 10 of FIG. 1 by its grating 21. The grating 21 also comprises a frame 210 placed next to the aperture 14 of the horn 20, and a set of plates 211, 212 and 213 placed parallel to the x-z plane in the embodiments of the figures. The frame supports the plates. The plates 211-213 extend longitudinally between two sides of the frame 150. More precisely, the plates extend longitudinally and continuously from a first short side 250*a* of the frame to a second short side 250*b* of the frame 250. In the embodiment of the figure, nonlimitingly, the first side 250*a* and the second side 250*b* extend longitudinally parallel to the y-axis. The frame also comprises a first long side 250*c* and a second long side 250*d*. The sides 250*c* and 250*d* are orthogonal to the sides 250*a*, 250*b*, the frame being rectangular in FIG. 2.

The geometric properties of the grating 21 are defined identically to those of the grating 15 of FIG. 1. The grating 21 differs from the grating 15 in that it comprises corrugations 22. The grating 21 is said to be corrugated. The corrugations 22 for example consist of slits, notches or crenulations. Mechanically, they may correspond to grooves produced along the y-axis in the external face of the frame 210 and/or in the plates 211-213. The expression "external face" is understood to mean the surface oriented in the opposite direction to the entrance 13 of the horn 20. The corrugations 22 are advantageously rectangular or U-shaped in the x-z plane. In practice, the corrugations 22 may be produced either by machining or by moulding of the grating 21. The corrugations 22 improve the attenuation of the amplitude of any electric field that is not polarised along the y-axis, relative to a simple grating such as the grating 15 of FIG. 1. In particular, they enable improved filtering, i.e. improved attenuation of the cross-polarisation components of the electric fields of the electromagnetic waves emitted in the operating frequency band of the waveguide. This therefore means that the filtering obtained will be better, and more uniform, in the operating frequency band of the waveguide. Moreover, the corrugations allow the cross-components to be attenuated over a wider frequency band than the attenuation device shown in FIG. 1. It will be recalled that the electric fields of the electromagnetic waves emitted into the waveguide are preferably oriented essentially in the y-direction, even before passing through the grating. Passage through the grating further improves this orientation by limiting cross-polarisation components. The electric fields at the exit of the waveguide are therefore necessarily oriented essentially in the y-direction.

The attenuation of electromagnetic waves the electric field of which is not polarised along the y-axis, in particular the attenuation of cross-polarisation components, is enhanced by the geometric properties of the corrugations 22, namely their dimensions and their positions. These geometric properties of the corrugations 22 are defined depending on the operating frequency band of the antenna. The geometric properties having the most significant impact on the electromagnetic properties of the grating are the depth of the corrugations and the interval between adjacent corrugations along the x-axis. The depth of a corrugation 22 is defined as the distance along the z-axis between, on the one hand, the external surface of the frame 210 or the plates 211-213 and, on the other hand, the bottom of the slit 22 considered. The depth of the corrugations is advantageously dimensioned to form a "quarter-wave trap". In other words, it is substantially equal to a quarter of the wavelength $\lambda_0$ ($\lambda_0/4$). However, in order to preserve optimal filtering over the entire width of the frequency band, it is possible to consider a number of particular frequencies in the frequency band. Specifically, low-frequency signals have a tendency to disperse more towards the edges of the grating than to the centre, whereas higher frequency signals are more directional and therefore concentrate more at the centre of the grating. This property may be used in order to dedicate various portions of the grating to filtering particular separate frequencies. In the example of FIG. 2, four particular frequencies are considered. Each particular frequency corresponds to a wavelength and is associated with a set of corrugations 22. Each particular frequency thus requires a separate corrugation depth from the others. As may be seen in FIGS. 2, 3A, 3B, the dimensions of the corrugations vary between the first side 250*a* and the second side 250*b* of the frame. Since operation of the horn 20 is symmetric relative to the y-z plane, the corrugations 22 may be produced symmetrically relative to the y-z plane passing through the centre of the grating. In the particular embodiment shown in FIG. 2, a first set 221 of corrugations 22 is produced in the frame 210 and the plates 211-213 so that the corrugations are aligned along the y-axis passing through the centre of the longest sides of the frame 210, sets of corrugations 222A-222B, 223A-223B, and 224A-224B being produced symmetrically on either side of the first set 221. The interval between adjacent corrugations along the x-axis is the main criteria of optimisation of the filtering nature of the corrugations 22. The interval between two adjacent corrugations 22 is defined as the distance along the x-axis between the contiguous edges of these corrugations 22 or, as the case may be, between the internal edge of the frame 210 and the contiguous edge of the adjacent corrugation 22. Nevertheless, since the width of the corrugations is relatively small relative to the interval between corrugations, this interval may also be defined as the distance between the centres of the corrugations. The interval between adjacent corrugations 22 is advantageously substantially equal to a quarter of the wavelength $\lambda_0$ ($\lambda_0/4$). However, analogously to the depth of the corrugations, it is possible to consider a number of particular frequencies in the operating frequency band. Because of the operating symmetry of the horn, the intervals between corrugations are normally symmetric relative to the y-z plane passing through the centre of the grating 21. The width of the corrugations has a secondary influence on the electromagnetic properties of the grating 21. Furthermore, this dimension is constrained by the size of the aperture 14 of the horn 20 along the x-axis, by the number of corrugations along the x-axis, and by the intervals between the corrugations. The width of the corrugations must nevertheless be sufficient to allow them to be produced by machining or moulding of the grating 21. By way of example, the corrugations may be substantially equal to 1 mm in width. Preferably, the higher the particular frequency considered, the smaller the width. Thus, the width of the corrugations increases from the centre towards the frame and notably towards the edges of the frame 210.

Figure 3A:
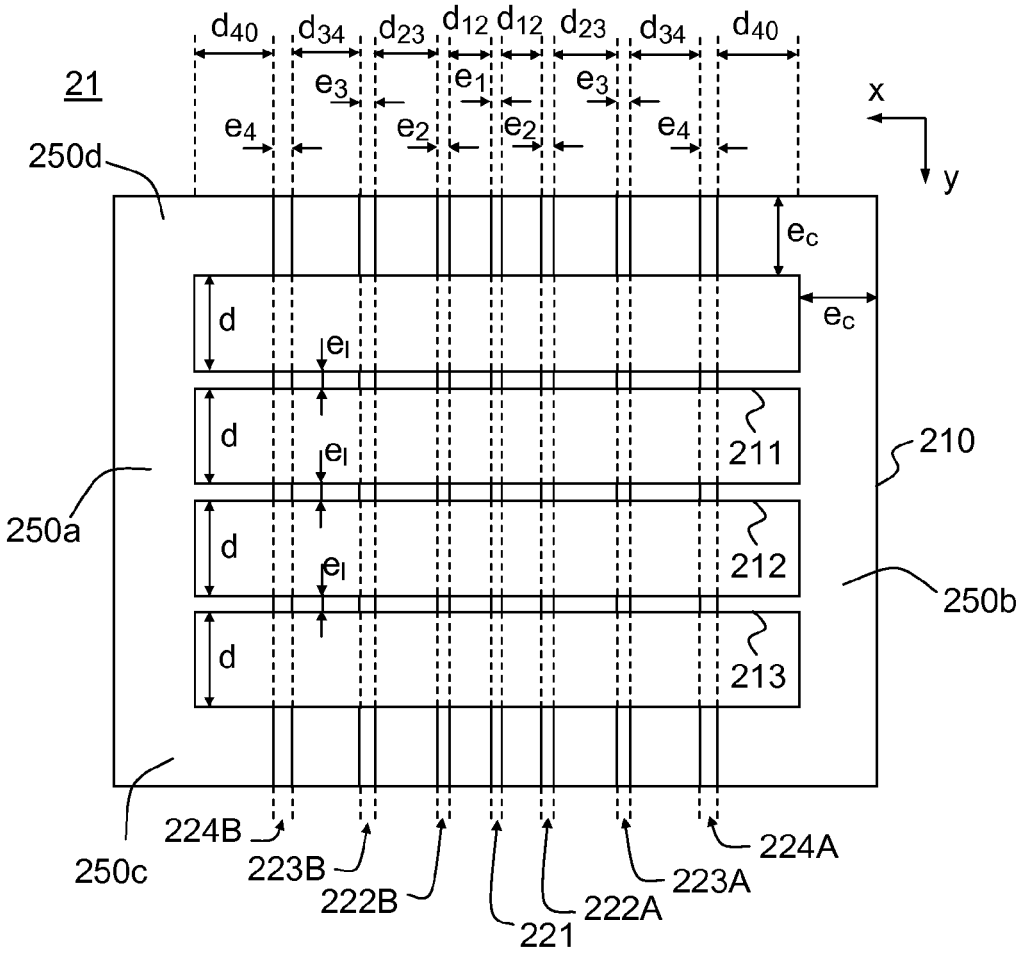
FIGS. 3A and 3B show a top view and a side view, respectively, of an example of a grating according to FIG. 2, dimensioned for a given frequency band.
Figure 3B:
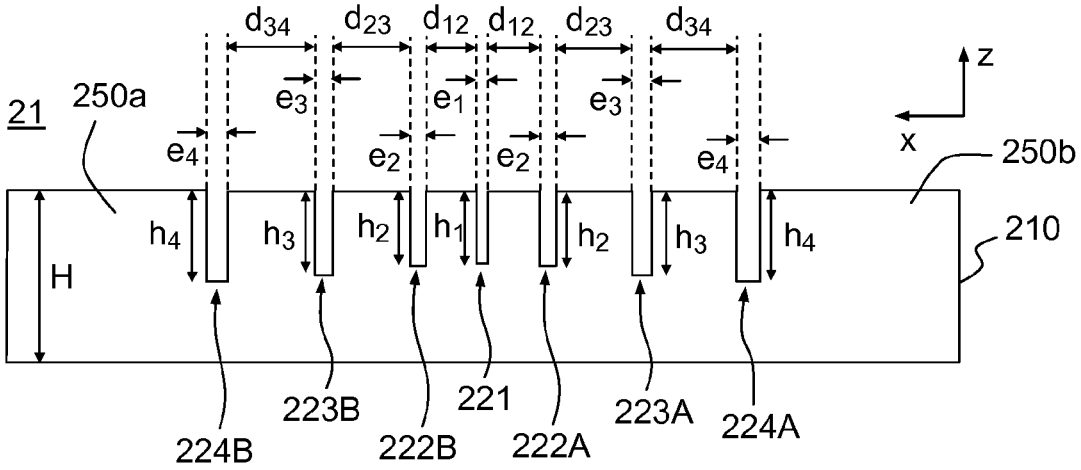

FIGS. 3A and 3B show a top view and a side view, respectively, of an example of a grating according to FIG. 2 dimensioned for a frequency band lying between 10.3 GHz and 14.75 GHz. The height of the grating 21 along the z-axis is denoted H, the interval between adjacent plates along the y-axis is denoted d, the thickness of the frame 210 along the x- and y-axes is denoted $e_c$, the thickness of the plates along the y-axis is denoted $e_l$, and the depth of the corrugations 22 of the sets 221 to 224 along the z-axis is denoted $h_1$ to $h_4$, respectively. Furthermore, along the x-axis, the interval between the corrugations of the first set 221 and those of the set 222A (respectively 222B) is denoted $d_{12}$, the interval between the corrugations of the set 222A (respectively 222B) and those of the set 223A (respectively 223B) is denoted $d_{23}$, the interval between the corrugations of the set 223A (respectively 223B) and those of the set 224A (respectively 224B) is denoted $d_{34}$, and the interval between the corrugations of the set 224A (respectively 224B) and the contiguous internal edge of the side 250*b* (respectively 250*a*) of the frame 210 is denoted $d_{40}$. Lastly, the widths of the corrugations 22, along the x-axis, of the sets 221 to 224 are denoted $e_1$ to $e_4$, respectively.

The following frequencies are considered: $f_0$=12.5 GHz, $f_1$=14.75 GHz, $f_2$=14.25 GHz, $f_3$=12.75 GHz and $f_4$=11.7 GHz. Each frequency $f_1$ to $f_4$ is associated with a set of corrugations 221, 222A-222B, 223A-223B or 224A-224B. These frequencies allow the depths $h_1$ to $h_4$ of the corrugations of the sets 221 to 224, respectively, to be defined. With $C_0=3.10^8$ m/s, the wavelengths associated with the frequencies $f_0$ to $f_4$ are respectively $\lambda_0$=24 mm, $\lambda_1$=20.34 mm, $\lambda_2$=21.05 mm, $\lambda_3$=23.53 mm and $\lambda_4$=25.64 mm.

For the various zones of the grating 21 located between the corrugations, the following frequencies are considered: $f_{12}$=14.5 GHz, $f_{23}$=13.75 GHz, $f_{34}=f_0$=12.5 GHz and $f_{40}$=10.3 GHz. They allow the intervals between adjacent corrugations to be defined. The wavelengths associated with these frequencies are $\lambda_{12}$=20.69 mm, $\lambda_{23}$=21.82 mm, $\lambda_{34}$=24.00 mm, and $\lambda_{40}$=29.13 mm, respectively. For these frequencies, the dimensions of the grating 21 are for example the following:

H=12 mm, set to $\lambda_0/2$;

d=8.25 mm;

$e_c$=7.0 mm;

$e_l$=1.0 mm;

$h_1$=5.08 mm; $h_2$=5.26 mm; $h_3$=5.88 mm; $h_4$=6.41 mm;

$d_{12}$=5.17 mm; $d_{23}$=5.46 mm; $d_{34}$=6.00 mm; $d_{40}$=7.28 mm;

$e_1$=0.75 mm; $e_2$=1.0 mm; $e_3$=1.25 mm; $e_4$=1.5 mm.

In other words, the dimensions and/or the intervals between the respective slits are defined by the wavelength corresponding to the frequency of the electric field having locally the largest amplitude at the grating 21, and in particular at the respective slits 22.

As may be seen in FIG. 2, the long sides 250*d* and 250*c* of the frame comprise corrugations. These corrugations are spaced apart in the longitudinal direction of the sides. The corrugations advantageously extend right through the thickness of these sides in a direction perpendicular to the z-axis. The corrugations formed in each long side extend right through the thickness of the long side in a direction perpendicular to the longitudinal direction of the long side. In this way the corrugations emerge onto the top and bottom of this side. In the embodiment of FIG. 2, the corrugations extend right through the thickness of the respective long sides in the y-direction. The corrugations formed in a side take, for example as may be seen in FIG. 2, the form of a channel extending longitudinally in a direction perpendicular to the longitudinal direction of said side and have a rectangular cross section in the x-z plane.

As a variant (not shown) or in addition to the corrugations in the long sides, the short sides 250*a* and 250*b* of the frame comprise corrugations extending right through their respective thicknesses in a direction perpendicular to the z-axis. The corrugations of each short side extend right through the thickness of the short side perpendicularly to the longitudinal direction of the short side. In this way they emerge onto the top and bottom of the side. In the case where the short sides extend longitudinally along the y-axis, the corrugations extend right through their respective thicknesses in the x-direction. The corrugations formed in a side take, for example, the form of a channel extending longitudinally in a direction perpendicular to the longitudinal direction of said side (y-direction) and have a rectangular cross section in the y-z plane.

Advantageously, at least one of the sides of the frame comprises corrugations extending right through its thickness.

Figure 4A:
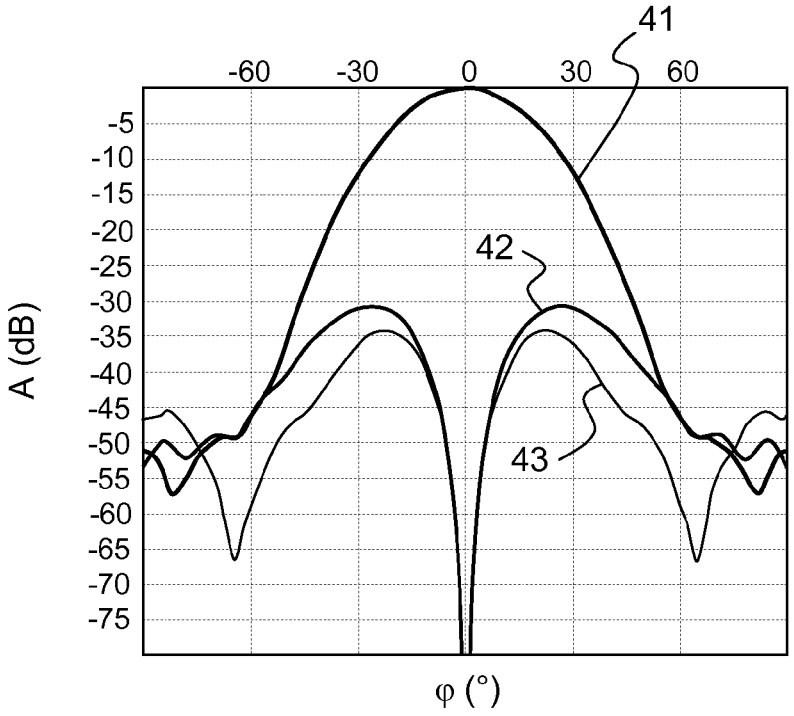
FIGS. 4A, 4B and 5 illustrate, via graphs, the impact of the grating according to the invention on the performance of the waveguide.
Figure 4B:
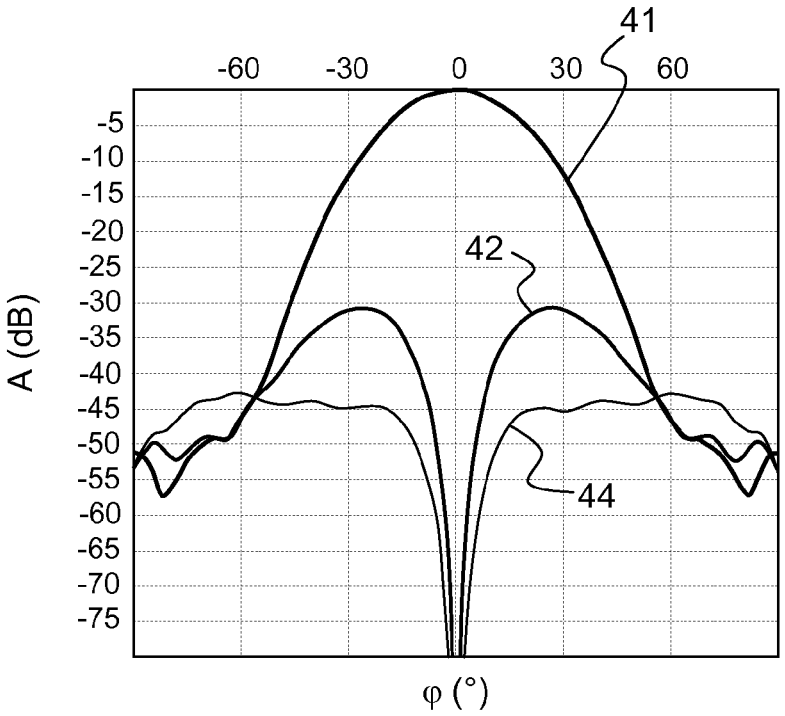
Figure 5:
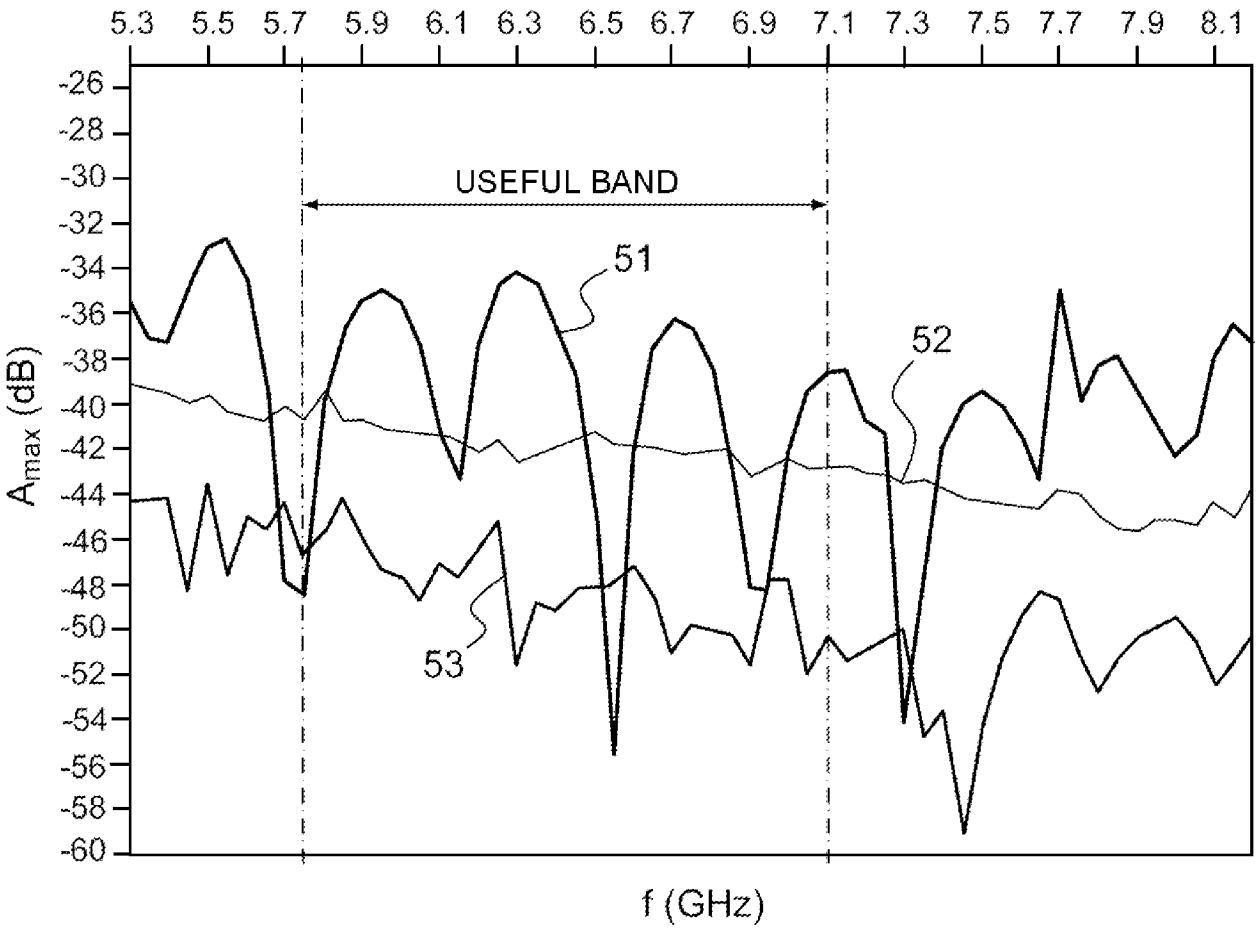

FIGS. 4A, 4B and 5 illustrate, via graphs, the improvement in the performance of a C-band horn due to the presence of a grating according to the invention relative to the same horn not fitted with a grating, and relative to the same horn equipped with a simple grating (without corrugations).

In the graphs of FIGS. 4A and 4B, the amplitudes A, in dB, of the co-polarisation and cross-polarisation components of the electric field of an electromagnetic wave are drawn as a function of the angle of elevation $\phi$ and for a single frequency. The angle of elevation corresponds to the angle formed between the z-axis and the propagation direction of the electromagnetic wave. Typically, angles of elevation between 0° and 30 to 40° are essentially of interest. In the graph of FIG. 4A, the curve 41 shows the amplitude of the co-polarisation component for a grating-less horn, the curve 42 shows the amplitude of the cross-polarisation component for a grating-less horn, and the curve 43 shows the amplitude of the cross-polarisation component for a horn equipped with a simple grating. In the graph of FIG. 4B, the curves 41 and 42 are reproduced, and the curve 44 shows the amplitude of the cross-polarisation component for a horn equipped with a grating comprising corrugations according to the invention. FIGS. 4A and 4B show cross-polarisation component maximum amplitudes substantially 30 dB below the co-polarisation component maximum amplitude for a grating-less horn, 35 dB for a horn equipped with a simple grating, and 45 dB for a horn equipped with the grating according to the invention.

In the graph of FIG. 5, the maximum amplitudes $A_{max}$ of the cross-polarisation components of the electric field of an electromagnetic wave are drawn for an angle of elevation between −10° and +10° as a function of frequency f. These maximum amplitudes are considered in decibels relative to the maximum amplitude of the co-polarisation component calculated for an angle of elevation between −180° and +180°, i.e. over the total sphere of radiation of the wave. The curve 51 shows the maximum amplitude, for an angle of elevation between −10° and +10°, of the cross-polarisation component for a grating-less horn. The curve 52 shows this maximum, for an angle of elevation between −10° and +10°, and for a horn equipped with a simple grating, and the curve 53 shows this maximum for an angle of elevation between −10° and +10° and for a horn equipped with a grating comprising corrugations. The weakest attenuation of the cross-polarisation component in the operating frequency band for a horn equipped with a grating according to the invention is substantially equal to −44 dB, whereas it is approximately equal to −40 dB for a horn equipped with a simple grating and −34 dB for a grating-less horn.

The corrugated grating according to the invention also has the advantage of improving the standing wave ratio by about 1 to 5 dB and the gain of the horn by a few tenths of a decibel. It makes it possible to obtain cross-polarisation component maximum amplitudes 40 dB below the co-polarisation component maximum amplitudes with pyramidal horns.

In the example of FIGS. 2, 3A and 3B, the horn 20 is pyramidal, i.e. it comprises a segment 12 the dimensions of which in the transverse plane increase linearly along the propagation axis of the electromagnetic wave. Nevertheless, the invention applies to any other type of horn, in particular what are called trifurcated horns and corrugated horns.

Moreover, a horn according to the invention may comprise a number of gratings in addition to the grating 21 placed next to the aperture 14 of the horn 20. These additional gratings also contain corrugations in their plates and/or in the edges of their frame. The gratings are, for example, regularly spaced apart from each other (pairwise) by a distance ranging between the wavelength $\lambda_0$ and one eighth of this wavelength. The additional gratings may optionally be identical to the grating 21.

Figure 6:
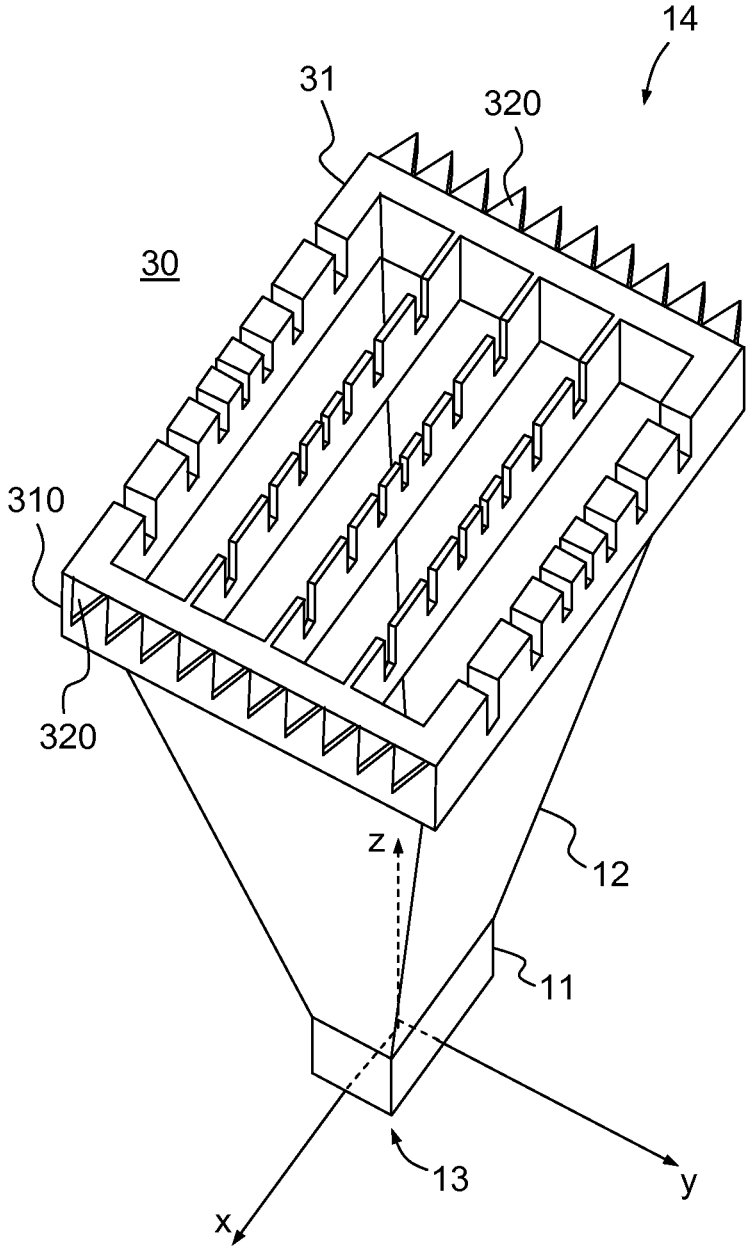
FIG. 6 shows a particular embodiment of a waveguide according to the invention.

FIG. 6 shows a particular embodiment of a waveguide according to the invention. The horn 30 differs from the horn 20 of FIG. 2 in that the frame 310 of the grating 31 comprises protruding parts 320 extending in an x-y plane, i.e. in a plane orthogonal to the z-axis. These protruding parts 320 are, for example, placed on the shortest sides of the frame 310, as shown in FIG. 6. However, the protruding parts may also be placed right around the perimeter of the frame 310, or only on the longest sides. Moreover, the protruding parts may extend either towards the interior of the frame 310 or towards its exterior, as shown in FIG. 6. The protruding parts may for example correspond to saw teeth or rectangular crenulations.

In the embodiment of the figures, the plates extend longitudinally in the direction substantially parallel to the x-axis. The position and dimensions of the corrugations are defined in and/or relative to this axis. In other words, the longitudinal direction of the plates forms an angle smaller than 0.05° with the x-axis, about the z-axis.

As an advantageous variant, the plates extend longitudinally in a direction forming, with the x-axis, about the z-axis, an angle at least equal to 0.05° and between 0.05 and 5°. In this case, the position (for example the interval between the corrugations) and the dimensions of the corrugations (for example their width) are defined in and/or relative to the longitudinal direction of the plates. In certain practical cases, this embodiment advantageously enables a better attenuation of cross-polarisation components extending along the x-axis.

In these two embodiments, given that the angle formed between the longitudinal direction of the plates and the x-axis is at most equal to 5°, the plates are assumed and said overall to extend longitudinally along the x-axis.

The plates form overall rectangular parallelepipeds having a side extending along the z-direction Embodiments in which the depth of the corrugations, the interval between the corrugations, or the height of the plate were equal to a fraction (a quarter or half) of the wavelength of the central frequency were described above. As a variant, these dimensions and positions are equal to a fraction (a quarter or half) of the wavelength of a frequency contained in the operating frequency band of the waveguide.

The invention claimed is:

1. A waveguide, comprising:

a horn-shaped segment, an entrance, an aperture, and a grating placed next to the aperture, wherein the waveguide is configured to transmit at least one linearly polarised electromagnetic wave for propagation between the entrance and the aperture of the waveguide along a first axis, the grating comprising a frame encircling a set of plates extending longitudinally and continuously from a first short side of the frame to a second short side of the frame, to form a linear polarising filter attenuating a cross-polarisation component of the electric field of the electromagnetic wave, said cross-polarisation component being orthogonal to a second axis orthogonal to the first axis, each plate of the set of plates includes corrugations, depths of respective corrugations and intervals between adjacent corrugations along a direction in which the set of plates longitudinally extend being dimensioned and positioned to reinforce the attenuating of said cross-polarisation component, wherein the corrugations are slits cut in a side opposite the entrance of the waveguide, each corrugation having a depth along the first axis and a width along the direction in which the set of plates longitudinally extend from the first short side to the second short side, the depths of respective corrugations and the intervals between respective adjacent corrugations along the direction in which the set of plates longitudinally extend being defined to reinforce the attenuating of said cross-polarisation component, widths of said respective corrugations being smaller relative to the intervals between the adjacent corrugations and relative to depths of said respective corrugations.

2. The waveguide according to claim 1, in which the corrugations are rectangular slits cut in the side opposite the entrance of the waveguide.

3. The waveguide according to claim 1, in which the corrugations have dimensions that vary depending on their position in the direction in which the plates extend longitudinally between the first and second short sides of the frame, as a function of the frequency of the electric field of the electromagnetic wave having locally the largest amplitude at the respective corrugations.

4. The waveguide according claim 2, in which the depth of the slits is substantially equal to a quarter of the wavelength corresponding to the frequency of the electric field having locally the largest amplitude at the respective slits, and being essentially oriented along the second axis.

5. The waveguide-according to claim 2, in which the depth of the slits is substantially equal to a quarter of the wavelength corresponding to a frequency of an operating frequency band of the waveguide, the electromagnetic wave emitted in said operating frequency band having an electric field essentially oriented along the second axis.

6. The waveguide according to claim 3, in which the higher the frequency having locally the largest amplitude, the smaller the width of the slits.

7. The waveguide according to claim 1, in which the interval between two adjacent corrugations in the direction in which the plates extend longitudinally is substantially equal to a quarter of the wavelength corresponding to the frequency of the electric field of the electromagnetic wave having locally the largest amplitude at the respective slits.

8. The waveguide according to claim 1, in which the interval between two adjacent corrugations in the direction in which the plates extend longitudinally is substantially equal to a quarter of the wavelength corresponding to a frequency of an operating frequency band of the waveguide, the electromagnetic wave emitted in said operating frequency band having an electric field essentially oriented along the second axis.

9. The waveguide-according to claim 1, in which the frame comprises corrugations.

10. The waveguide-according to claim 9, in which the frame comprises corrugations extending right through the thickness of at least one side of the frame in a direction perpendicular to the first axis.

11. The waveguide according to claim 10, in which the frame comprises corrugations extending right through the thickness of at least one side of the frame along the second axis and/or corrugations extending right through the thickness of at least one side of the frame along a third axis orthogonal to the first axis and to the second axis.

12. The waveguide according to claim 1, in which the corrugations are aligned in sets along the second axis, the corrugations of a given set having identical dimensions.

13. The waveguide according to claim 1, in which the plates extend longitudinally in a direction substantially parallel to a third axis orthogonal to the second axis and orthogonal to the first axis.

14. The waveguide according to claim 1, in which the plates extend longitudinally in a direction making, with a third axis orthogonal to the second axis and orthogonal to the first axis, an angle between 0.05° and 5° about the first axis.

15. The waveguide according to claim 1, in which the waveguide is designed to operate in an operating frequency band, the plates having a height along the z-axis substantially equal to half a wavelength corresponding to a frequency in the operating frequency band of the waveguide.

16. The waveguide according to claim 1, in which the grating is placed at a non-zero distance away from the aperture of the waveguide along the first axis.

17. The waveguide according to claim 1, comprising at least one additional grating, the gratings being spaced apart pairwise along the first axis by a distance ranging from the wavelength corresponding substantially to a central frequency of an operating frequency band of the waveguide, to one eighth of this wavelength.

18. The waveguide-according to claim 17, in which one or more additional gratings are placed parallel to the grating placed next to the aperture.

19. The waveguide according to claim 17, in which one or more additional gratings each comprise corrugations.

20. The waveguide-according to claim 17, in which each additional grating is substantially identical to the grating placed next to the aperture.

21. A satellite antenna comprising a waveguide according to claim 1.

22. The waveguide according to claim 1, in which the interval between two adjacent corrugations in the direction in which the plates extend longitudinally is substantially equal to a half of the wavelength corresponding to the frequency of the electric field of the electromagnetic wave having locally the largest amplitude at the respective slits.

23. The waveguide according to claim 1, in which the interval between two adjacent corrugations in the direction in which the plates extend longitudinally is substantially equal to a half of the wavelength corresponding to a frequency of an operating frequency band of the waveguide, the electromagnetic wave emitted in said operating frequency band having an electric field essentially oriented along the second axis.

24. The waveguide according to claim 1, wherein heights of respective plates, intervals between respective adjacent plates and intervals between external plates and the internal edge of the frame are defined to form a linear polarising filter attenuating the cross-polarisation component of an electric field of the electromagnetic wave.

* * * * *